US006752475B2

(12) United States Patent
Steadman

(10) Patent No.: US 6,752,475 B2
(45) Date of Patent: Jun. 22, 2004

(54) STORAGE APPARATUS

(75) Inventor: William D. Steadman, Port Saint Lucie, FL (US)

(73) Assignee: William David Steadman, Port Saint Lucie, FL (US)

( * ) Notice: Subject to any disclaimer, the term of this patent is extended or adjusted under 35 U.S.C. 154(b) by 48 days.

(21) Appl. No.: 10/027,339

(22) Filed: Dec. 20, 2001

(65) Prior Publication Data

US 2002/0084732 A1 Jul. 4, 2002

(30) Foreign Application Priority Data

Dec. 23, 2000 (GB) ..... 0031597

(51) Int. Cl.[7] ..... A47B 67/02

(52) U.S. Cl. ..... 312/246; 312/267; 312/319.6; 312/322

(58) Field of Search ..... 312/242, 246, 312/247, 248, 319.5, 319.6, 319.7, 319.8, 322, 267, 266, 319.3; 108/94, 95, 149

(56) References Cited

U.S. PATENT DOCUMENTS

| | | | | | |
|---|---|---|---|---|---|
| 1,940,877 | A | * | 12/1933 | Ochse | 312/322 |
| 2,473,239 | A | * | 6/1949 | Boyd | 312/319.3 |
| 3,081,138 | A | * | 3/1963 | Stebbins | 312/319.3 |
| 3,857,623 | A | * | 12/1974 | Schneller | 312/266 |
| 4,026,434 | A | | 5/1977 | Howard | |
| 4,076,351 | A | | 2/1978 | Wyant | |
| 4,874,211 | A | * | 10/1989 | Nichols | 312/269 |
| 4,915,461 | A | | 4/1990 | Kingsborough et al. | |
| 5,224,677 | A | * | 7/1993 | Close | 248/292.11 |
| 5,249,858 | A | | 10/1993 | Nusser | |
| 5,857,756 | A | | 1/1999 | Fehre | |
| 6,209,405 | B1 | * | 4/2001 | Milsem | 74/89.21 |

FOREIGN PATENT DOCUMENTS

| | | | | |
|---|---|---|---|---|
| DE | 3409990 A1 | * | 7/1984 | A47B/96/14 |
| DE | 3433137 A1 | | 3/1986 | |
| DE | 29807238 U1 | * | 7/1998 | A47B/51/00 |
| JP | 2000300300360 | | 4/1999 | |
| WO | WO 95/12335 | | 5/1995 | |
| WO | WO 97/17867 | | 5/1997 | |

* cited by examiner

*Primary Examiner*—Lanna Mai
*Assistant Examiner*—John Fitzgerald
(74) *Attorney, Agent, or Firm*—Watts, Hoffmann Co., LPA

(57) ABSTRACT

A disclosed storage apparatus comprises a cupboard body and a lifting arrangement. The lifting arrangement is mounted on a wall or other fixture and selectively moves the cupboard body between a raised position adjacent the wall or fixture and a lowered position outward from the wall or fixture. Shelves are arranged in the storage cupboard to remain at a constant alignment irrespective of the alignment of the cupboard body.

18 Claims, 4 Drawing Sheets

STORAGE APPARATUS

This invention concerns improvements in or relating to storage apparatus.

In kitchens and other locations it is often desired to have wall mounted cupboards above a work surface. To render the work surface wholly usable the cupboards must be spaced thereabove, which tends to mean that the cupboards are relatively high and therefore not readily accessible. This may mean that a person accessing the cupboards has to use a stool, steps or chair to stand on, which is not wholly satisfactory.

According to the present invention there is provided storage apparatus, the apparatus comprising a storage compartment and a movement arrangement, the movement arrangement being mountable on a wall or fixture and arranged to selectively move the storage compartment between a raised position adjacent the wall or fixture and a lowered position, the movement arrangement being arranged such that as the storage apparatus moves towards the lowered position the storage apparatus also moves outwardly away from the wall or fixture.

The storage compartment is preferably mounted on a moving part of the movement arrangement, with the moving part pivotally mounted to the remainder of the movement arrangement so as to be pivotally movable away from a wall or fixture upon which the apparatus is mounted.

The moving part may be of variable length such that as the moving part lengthens the storage compartment is lowered, and as the moving part shortens the storage compartment is raised.

A pivotal link may extend between the storage compartment or moving part and a fixed point on the movement arrangement, and the pivotal link may be arranged such that in the raised position the pivotal link lies generally parallel to the moving part, and as the storage compartment is moved towards the lowered position the pivotal link pivots relative to the moving part causing the storage compartment to be moved away from the remainder of the movement arrangement.

The moving part may comprise first and second parts in a telescopic arrangement. The first part may be threaded and movable into or out of the second part by virtue of rotation and threadable engagement with the second part. An electric motor may be provided to selectively rotate the first part in either direction.

The storage compartment is preferably fixedly mounted to the moving part, and desirably to the second part thereof, so as to pivot therewith. One or more storage structures, which may comprise shelves, are preferably provided in the storage compartment and arranged so as to remain at a substantially constant alignment irrespective of the alignment of the storage compartment. The storage structures are preferably pivotally mounted on the storage compartment.

A line means preferably extends from a point to the or each storage structure such that the line means urges the storage structure to the substantially constant alignment as the storage compartment pivots. The line means may extend from a point on the moving part to the storage structures via a point on the remainder of the movement arrangement. The line means may engage with a wheel or other guide at said point on the remainder of the movement arrangement.

The movement arrangement may comprise a frame which is mountable on a wall or fixture, and the frame may be engageable with adjacent similar frames to provide a plurality of adjacent storage apparatus.

An embodiment of the present invention will now be described by way of example only and with reference to the accompanying drawings, in which.

Figure 1:
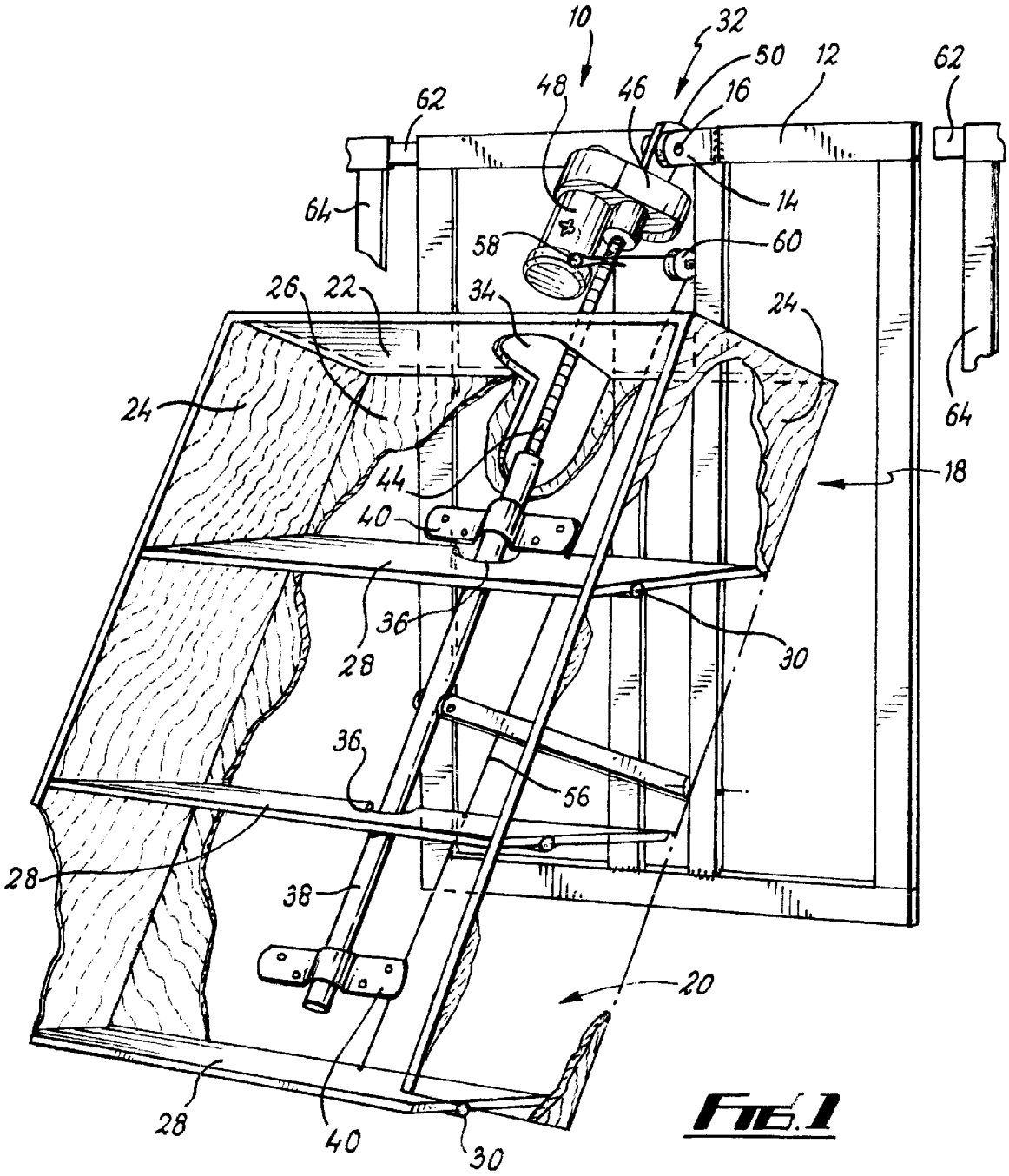
FIG. 1 is a diagrammatic, partially removed perspective view of storage apparatus according to the invention.
Figure 2:
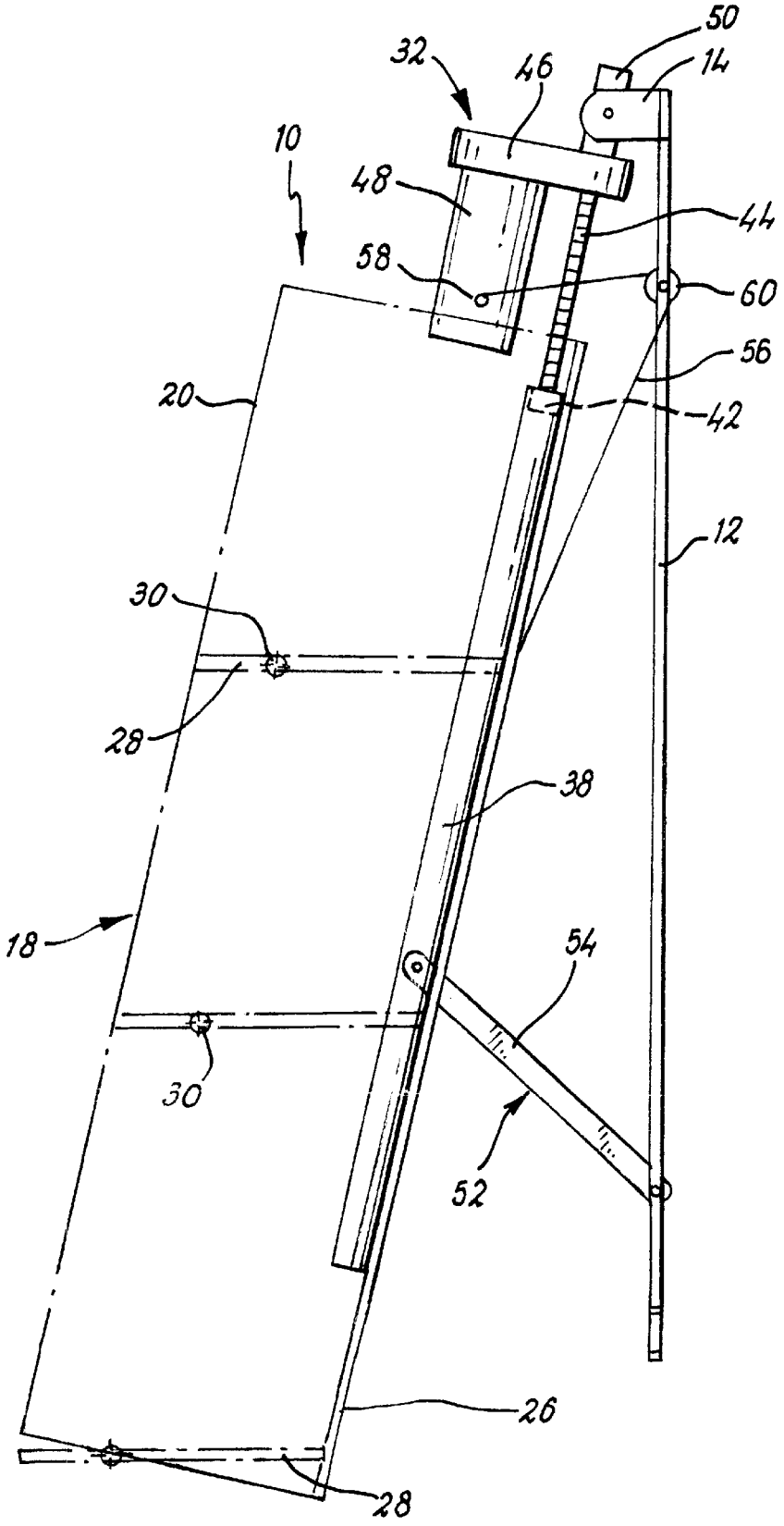
FIG. 2 is a diagrammatic sectional side view of the apparatus of FIG. 1.

FIGS. 1 and 2 of the drawings show storage apparatus 10 in the form of a cupboard arrangement mountable for instance in a kitchen above a work surface. The apparatus comprises a rectangular frame 12 mountable on a wall or other fixture, with a pair of mounting fingers 14 extending from an upper mid-point thereof with aligned holes 16 therein.

The apparatus 10 also provides a cupboard arrangement 18. The arrangement 18 is a cabinet including a body 20 comprising a top wall 22, side walls 24 and a rear base 26 or back. Three spaced shelves 28 are provided extending between the side walls 24 and pivotally mounted thereto about axes 30. The axes 30 are positioned towards the front of the body 20 so that the weight of the shelves urges the shelves downwardly at the rear to prevent the shelves tipping forwards and potentially spilling their contents.

A lifting arrangement is provided. A hole 34 is provided through the top wall 22, and holes 36 are provided through the top two shelves 28 to accommodate the lifting arrangement 32. The arrangement 32 comprises a tube 38 which is mounted on the inside of the rear base 26 by brackets 40 so as to extend upwardly through the holes 36. A thread is provided in at least the top of the tube 38 and may be provided by a trapped ut 42 as shown in FIG. 2. A threaded bar 44 telescopically extends upwardly from the tube 38. The upper end of the bar 44 engages in a gearbox 46 of a prime mover in the form of an electric motor 48 such that operation of the motor 48 causes the bar 44 to move into or out of the tube 38, dependant on the direction of rotation of the motor 48.

A pivotal link 52 in the form of an arm which extends between the tube 38 and frame 12. The link 52 is in the form of a bar 54 with pivotal connections at each end. The bar 54 connects between the frame 12 towards a lower central part thereof, and a point on the tube 38 about two thirds of the way from the top thereof. The link 52 is arranged such that when the bar 44 is located fully within the tube 38, the bar 54 lies substantially parallel to the frame 12 and hence the cupboard arrangement 18 will lie substantially against the frame 12.

A shelf alignment arrangement is provided which comprises a wire 56 which extends from a mounting 58 on the motor 48, around a wheel or pulley 60 on the frame 12 towards an upper part thereof but below the fingers 14, and to mountings on each of the shelves 28. The wire 56 is arranged such that the shelves 28 remain substantially horizontal irrespective of the alignment of the cupboard body 20. The cupboard body 20 would probably have front opening doors or the like but these have been omitted from the drawings for clarity.

Figure 3:
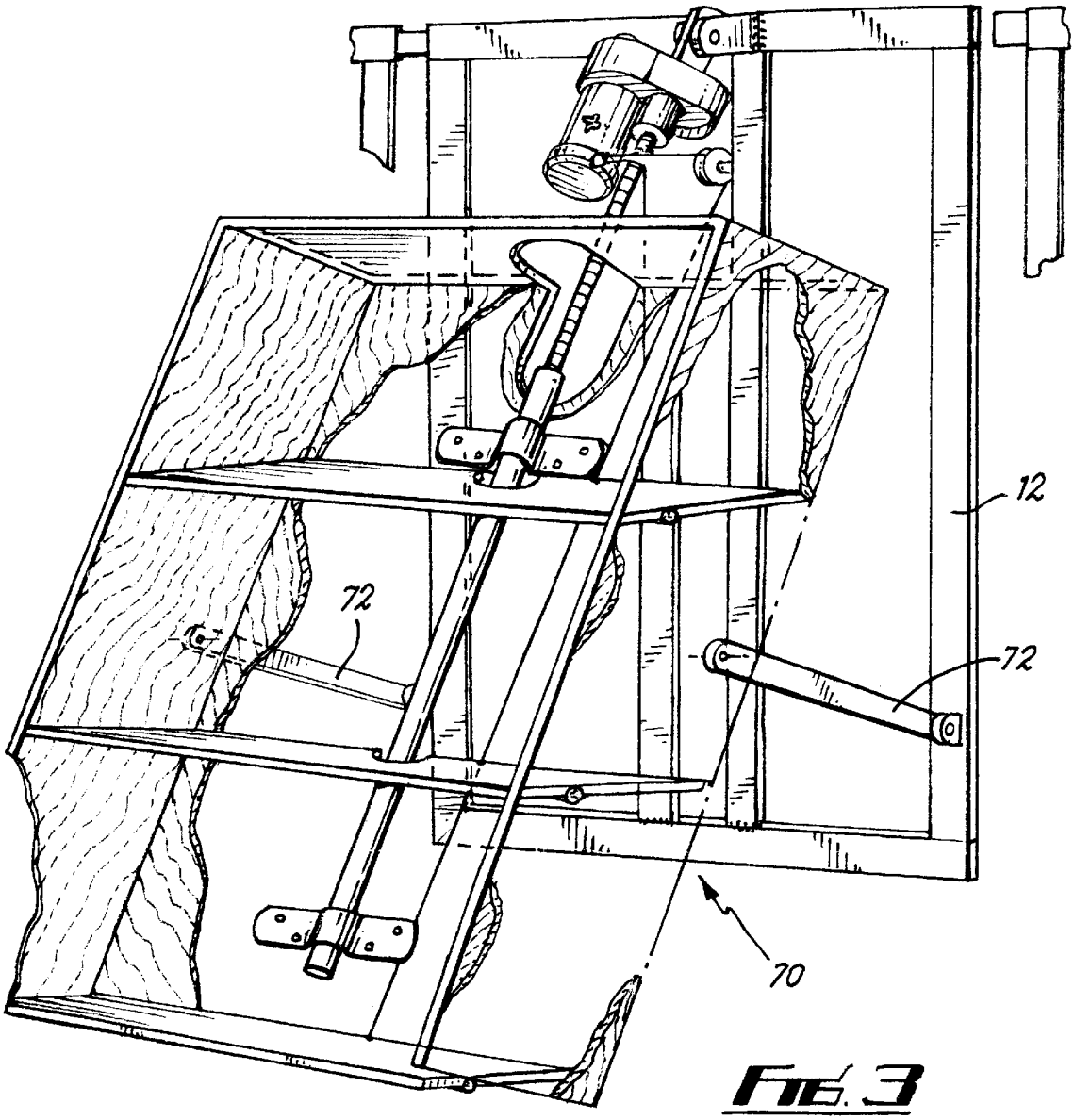
FIG. 3 is a similar view to FIG. 1 of a modified storage apparatus according to the invention.
Figure 4:
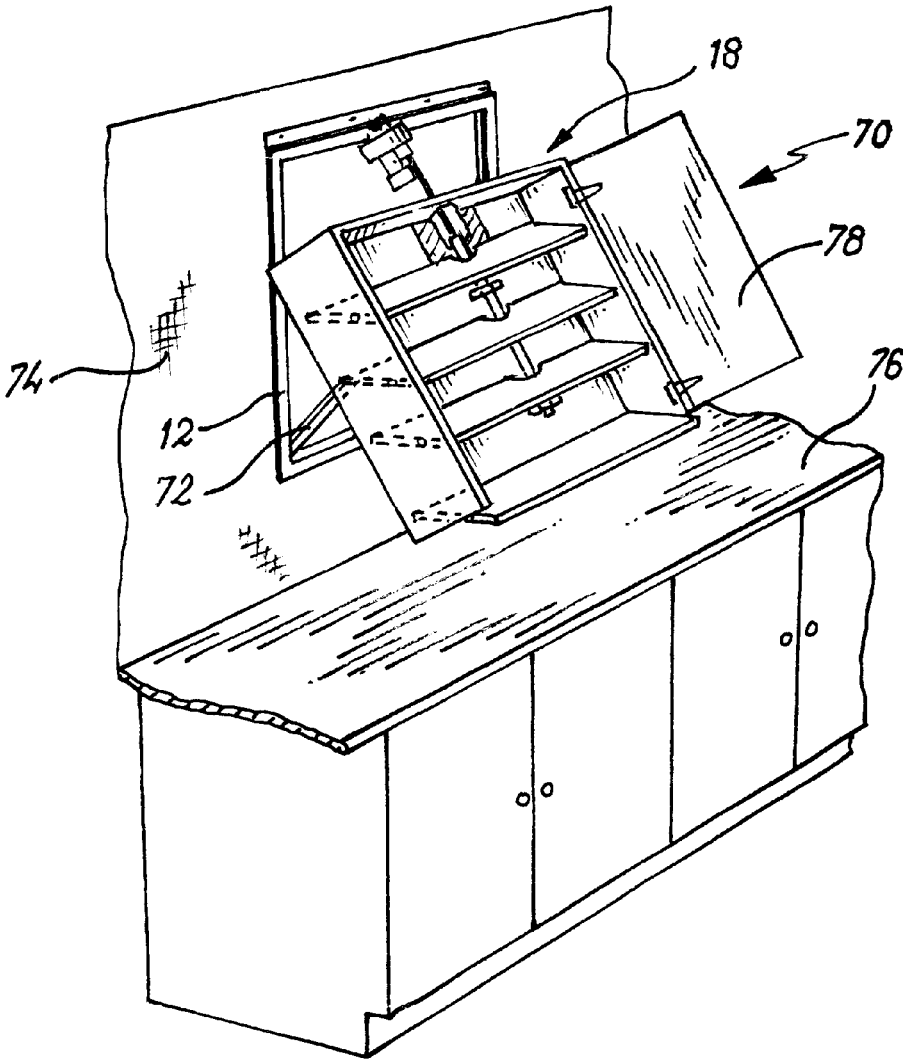
FIG. 4 is a diagrammatic perspective view of the apparatus of FIG. 3, in use.

FIGS. 3 and 4 show a modified storage apparatus 70 which is identical to the apparatus 10 except as follows. Instead of the single pivotal link bar 54, two further such bars 72 are provided, each extending respectively between the frame 12 and the cupboard rear base 26, towards a respective side thereof. FIG. 4 shows the apparatus 70 in use, with the cupboard arrangement 18 being lowered from a wall 74 upon which the frame 12 is mounted, to just above a work surface 76. Conventional doors 78 are provided on the arrangement 18, but only one of the doors 78 is shown for clarity.

In use in a fully raised position the bar 44 is located substantially wholly within the tube 38. The cupboard body 20 will be in a raised position flat against the frame 12. When it is required to lower the frame 12 to provide access to the interior of the body 20, the motor 48 is actuated to rotate the bar 44 in a required direction such that the bar moves outwardly from the tube 38. This causes the cupboard body 20 to lower. As the cupboard body 20 lowers the pivotal bar 54 or pivotal bars 72 will be caused to pivot outwardly away from the frame 12 and hence cause the body 20 to move to an inclined arrangement relative to the frame 12 as shown in the drawings. The wire 56 engaging with the shelves 28 causes the latter to remain substantially horizontal by pivotal movement about the axes 30 irrespective of the alignment of the body 20. The body 20 can be lowered to a position clear of a work surface therebelow or to perhaps engage with or locate adjacent the work surface spaced from the wall. When required the body 20 can be raised to its original position by operation of the motor 48 in an opposite direction.

There is thus described a storage apparatus which provides for considerable advantages. It has a relatively straightforward configuration and can thus be inexpensively manufactured to provide reliable and generally maintenance free operation. In a raised position the cupboard body will have a wholly conventional appearance, but the cupboards can be lowered to permit ready access thereto. A plurality of adjacent such cupboards could be provided, and FIG. 1 illustrates parts of adjacent frames 64. An opening or other formation could be provided to accept a projection 62 from an adjacent frame 64 as shown in FIG. 1.

Various modifications may be made without departing from the scope of the invention. For example the bar and tube could move relative to each other in a different manner, and for instance a pneumatic or hydraulic arrangement could be provided. A different arrangement could be provided for maintaining the shelves in a horizontal alignment. A different arrangement could be provided to cause the cupboard to move away from the wall. Whilst a relatively conventional kitchen cupboard arrangement is shown, the invention could be used with a wide range of storage apparatus, in many different applications.

What is claimed is:

1. A support for a storage cabinet comprising;

a) prime mover driven extendable mechanism including structure near one end of the mechanism for pivotal connection to a generally vertical support;

b) the mechanism also including other structure near another end of the mechanism remote from said one end for connection to such a cabinet;

c) a linkage including an arm operably connected to the mechanism near one end of the arm, the linkage also including a mounting pivotally connected to the arm at a location spaced from said one end of the arm; and, d) a flexible element connected to the mechanism near one end of the mechanism and connected to each of the pivotally mounted shelves of such a cabinet for maintaining the shelves horizontal as a connected cabinet is moved outwardly and downwardly from a storage position by extension of the mechanism and coaction of the linkage, the element also maintaining the shelves horizontal as the cabinet is returned to the storage position by a contraction of the mechanism.

2. A storage arrangement comprising:

a) a cabinet having spaced side walls;

b) the cabinet including a plurality of shelves between and pivotally connected to the side walls;

c) a support system connected to the cabinet and including an extensible prime mover mechanism for raising and lowering the cabinet between a raised storage position and a lowered access position; and, d) the support system including:

i) structure for mounting the arrangement on a support;

ii) linkage for causing a cabinet back to be essentially vertical when in the storage position and slanted outwardly from the support from top to bottom when the cabinet is in the access position; and, iii) elongated shelf control means connected to each of the shelves for maintaining the shelves in a generally horizontal orientation as the cabinet is moved from its storage to its access position.

3. The arrangement of claim wherein the shelf control mechanism is a flexible cable.

4. The arrangement of claim 2 wherein the extensible mechanism includes a pair of threadedly interconnected elongate members and a motor for relatively rotating the members.

5. The arrangement of claim 2 wherein the linkage is pivotally connected to the extensible mechanism and the structure for mounting includes parts of the extensible mechanism and the linkage is adapted to be pivotally connected to the support.

6. Storage arrangement according to claim 2, wherein the extensible mechanism comprises first and second parts in a telescopic arrangement.

7. Storage arrangement according to claim 6, wherein the first part is threaded and movable into or out of the second part by virtue of rotation and threaded engagement with the second part.

8. Storage arrangement according to claim 7, wherein an electric motor is provided to selectively rotate the first part in either directions.

9. Storage arrangement according to claim 2, wherein a plurality of cabinets are provided and arranged to remain at a substantially constant alignment.

10. In combination, the arrangement of claim 2 and a work surface wherein the work surface is below and spaced from the cabinet when the cabinet is in the lowered access position.

11. Storage arrangement according to claim 5, wherein the linkage is arranged such that in the storage position the linkage lies generally parallel to the moving part, and as the cabinet is moved towards the access lowered position the linkage pivots relative to the extensible mechanism causing the storage compartment to be moved away from the support.

12. Storage arrangement according to claim 9, wherein the cabinets are pivotally mounted on the support.

13. A cabinet assembly comprising:

a) a cabinet including a body and a plurality of shelves pivotally mounted in vertically spaced relationship between spaced side walls of the body;

b) a powered extensible mechanism connected to a rear base of the body and adapted to be connected to a support for moveably supporting a subassembly including the body and the shelves;

c) an elongated element connected to each of the shelves for maintaining the shelves in parallel relationship as the mechanism raises and lowers said subassembly; and, d) a linkage adapted to be interposed between the body and such a support for causing a lower portion of the body to move outwardly from such a support and outwardly relative to an upper portion of the body as said subassembly is lowered and to move the body toward the support as said subassembly is raised by the mechanism.

14. The assembly of claim the element is flexible.

15. The assembly of claim 13 wherein the linkage is pivotally connected to the mechanism.

16. The assembly of claim 13 wherein the mechanism includes threadedly interconnected rod and a tube and a motor adapted to cause the rod and tube to extend and contract as the rod and tube are rotated relatively.

17. In combination, the assembly of claim 13 and a work surface wherein the work surface is below and spaced from the cabinet when the cabinet is spaced above the work surface in all conditions including when in a fully lowered position.

18. The assembly of claim 13 wherein the linkage is pivotally connected to the mechanism.

* * * * *